US006190093B1

(12) United States Patent
Bastian et al.

(10) Patent No.: US 6,190,093 B1
(45) Date of Patent: Feb. 20, 2001

(54) U-SHAPED SHEET PILE WITH LOW CUT-THROUGH RESISTANCE

(75) Inventors: Roland Bastian, Mamer; Alex Schmitt, Noerdange; Charles Reinard, Esch/Alzette; Marc Meyrer, Mondercange, all of (LU)

(73) Assignee: Profilarbed S.A., Esch-sur-Alzette (LU)

( * ) Notice: Under 35 U.S.C. 154(b), the term of this patent shall be extended for 0 days.

(21) Appl. No.: 09/242,367

(22) PCT Filed: Jul. 22, 1997

(86) PCT No.: PCT/EP97/03951

§ 371 Date: Feb. 11, 1999

§ 102(e) Date: Feb. 11, 1999

(87) PCT Pub. No.: WO98/06905

PCT Pub. Date: Feb. 19, 1998

(30) Foreign Application Priority Data

Aug. 14, 1996 (LU) ..... 88805

(51) Int. Cl.[7] ..... E02D 5/08
(52) U.S. Cl. ..... 405/278; 405/274
(58) Field of Search ..... 405/274, 276–281

(56) References Cited

U.S. PATENT DOCUMENTS

| | | | | |
|---|---|---|---|---|
| 794,268 | * | 7/1905 | Wittekind | 405/276 |
| 797,786 | * | 8/1905 | Williams | 405/276 |
| 801,946 | * | 10/1905 | Wemlinger | 405/276 |
| 818,596 | * | 4/1906 | Williams | 405/276 |
| 848,143 | * | 3/1907 | Wemlinger | 405/276 |
| 937,817 | * | 10/1909 | Kreidler | 405/276 |
| 1,012,124 | * | 12/1911 | Conkling | 405/276 |
| 4,863,315 | * | 9/1989 | Wickberg | 405/274 X |

FOREIGN PATENT DOCUMENTS

| | | |
|---|---|---|
| 433704 | 5/1939 | (BE) . |
| 1135384 | 8/1962 | (DE) . |
| 434497 | 2/1912 | (FR) . |
| 686816 | 7/1930 | (FR) . |

* cited by examiner

*Primary Examiner*—Eileen D. Lillis
*Assistant Examiner*—Tara L. Mayo
(74) *Attorney, Agent, or Firm*—Chapman and Cutler

(57) ABSTRACT

A U-shaped sheet pile comprising a flat flange (10), two flat webs (12) connected to the flange (10) so as to be symmetrical with respect to a plane (8) perpendicular to the flange (10), and an interlocking element located at the end of each of the two webs (12). The sheet pile has a depth/useful width ratio greater than or equal to 0.18. The concave corners (18) defined by the two flange/web connections are significantly flattened by an extra thickness (26) of material so as to obtain a reduction in the resistance of the sheet pile to pile-driving. The extra thickness (26) is sufficient for a fictitious cylindrical surface (38), which has a radius at least equal to 75 mm and which is tangential to the planes extending the inner faces of the flange and the web (32, 34), to be completely located inside the said extra thickness (26) between its two tangential generators. The convex corners (16) are slightly rounded, the radius of curvature being less than or equal to 25 mm, and the connecting surfaces defining the concave corners (18) comprise cursed surfaces (30).

19 Claims, 1 Drawing Sheet

U-SHAPED SHEET PILE WITH LOW CUT-THROUGH RESISTANCE

BACKGROUND OF THE INVENTION

1. Field of the Invention

The present invention relates to a U-shaped sheet pile with a low resistance to pile-driving.

2. Description of Related Art

Over the last eighty years, several million tonnes of U-shaped sheet piles have been used worldwide for the construction of supporting walls, for example during work connected with excavation, and with the building of dams, dykes and reservoirs.

A U-shaped sheet pile has a flat back (called the flange of the sheet pile) to which are connected two legs (called webs of the sheet pile) carrying interlocking elements so that the sheet pile has a plane of symmetry perpendicular to the back. To form a supporting wall, these U-shaped sheet piles are assembled using the interlocking elements, with their backs alternately located on either side of the plane passing through the central axes of the interlocking elements. This plane then forms the neutral bending plane of the U-shaped sheet pile wall.

The standard methods of driving the sheet piles into the ground are ramming and vibration. It is known that pile-driving operations require the development of a considerable amount of energy, which is proportional to the resistance of the sheet pile to pile-driving. For a given pile-driving method, this resistance to pile-driving is mainly a function of the soil characteristics and the transverse cross-section of the sheet pile.

The "height" or "depth" of a U-shaped sheet is defined as the distance between a plane passing through the central axes of the two interlocking elements and the outer face of the flange, and the "useful width" of a U-shaped sheet pile is defined as the distance separating the central axes of the two interlocking elements. Sheet piles with a large useful width in principle make it possible to reduce the operational costs, since fewer sheet piles need to be driven into the ground to produce a given length of wall. Deep sheet piles can have lower thickness of material at the level of the flange and the webs while providing a high section modulus, which of course reduces the cost price of the sheet piles. Hence the interest in using wide and deep U-shaped sheet piles with lower thickness of material at the level of the flange and the webs.

Today, U-shaped sheet piles, available on the market as standard sections, have useful widths from 400 to 600 mm and a "depth/useful width" ratio from 0.18 to 0.54. The commonest U-shaped sheet piles have a "depth/useful width" ratio greater than or equal to 0.25, or even greater than 0.30. The thickness of the flange lies between 7 and 20 mm, and the thickness of the webs between 6 and 12 mm.

However, it should be pointed out that wide and deep sheet piles with low thickness of material at the level of the flange and the webs also become rapidly unstable under difficult pile-driving conditions. Hence the importance of limiting the stresses to which these sheet piles are exposed during the pile-driving, i.e. of having sheet piles with as low a resistance to pile-driving as possible. Now, although the reduction in the thickness of material at the level of the flange and the webs undoubtedly has a beneficial effect on the resistance to pile-driving, it is observed that an increase in the "depth/useful width" ratio unfortunately has a very adverse effect on the resistance to pile-driving of U-shaped sheet piles.

That being the case, it will be appreciated that the present invention has found a solution which makes it possible to have a reduction in the resistance of a U-shaped sheet pile to pile-driving while improving the stability of the sheet pile when it is being used.

Belgian patent No. 433704, which was published in 1939, describes sheet piles having the form of an angle-iron. It teaches to reinforce the concave corner defined by the two webs of the sheet pile by an extra thickness of material.

U.S. Pat. No. 1,012,124 discloses very compact sheet piles with a web made on the principle of a flat arch. These arched sheet-piles are supposed to replace flat sheet piles. Their depth/useful width ratio of these sheet piles is less than 0.10. They are conceived to enable the construction of very thin walls, having a total wall thickness that is substantially equal the thickness of the interlocks, so that the thickness of the wall will be no greater than that of flat sheet piles. In a preferred embodiment the arched sheet pile has a local extra thickness of material at the convex side of its two corners. It is specified that the addition of metal at these points increases the inertia and modulus and therefore greatly strengthens the individual section and the completed wall. It is further specified that this extra material also increases the length of the bearing for interior bracing timbers and at the same time tends to prevent deformation of the arch when under pressure.

BRIEF SUMMARY OF THE INVENTION

A U-shaped sheet pile in accordance with the present invention has a depth/useful width ratio greater than or equal to 0.18. it comprises more particularly a flange, which has a substantially flat outer face and an opposite, substantially flat inner face, two webs, which project from the flange, on the side of its inner face, so as to be symmetrical with respect to a plane perpendicular to the inner face, and an interlocking element connected to the free end of each of the two webs. Each of its two webs has a substantially flat outer face and an opposite, substantially flat inner face. In accordance with an important aspect of the present invention, this U-shaped sheet pile has a flange/web connection for each of the two webs that defines, on the side where the inner face of the web joins the inner face of the flange, a concave corner that is significantly flattened by an extra thickness of material in the flange/web connection, so as to obtain a reduction in the resistance of the sheet pile to pile-driving.

In the first place, it should be noted that, unlike what might be expected a priori, the reduction in the resistance to pile-driving is not obtained by a reduction in the thickness of the transverse cross-section of the sheet pile, but by extra thickness of material located at the level of the concave corners defined by the two flange/web connections.

The principal merit of the present invention is to have discovered that it is possible to reduce the resistance to pile-driving of a U-shaped sheet pile of given cross-section by an additional supply of material at the level of the concave corners. In fact, according to the present invention, the local extra thickness at the level of the concave corners mainly serve to flatten the concave corners at the position of the flange/web connection, i.e. to make these concave corners more open. During the pile-driving of the sheet pile by ramming or vibrations, this flattening of the concave corners facilitates the flow of soil particles outside the corners. In this way, substantial compaction of the soil in the concave corners is avoided, thus reducing the resistance of the sheet pile to pile-driving. It should be noted that the effect obtained is particularly pronounced in sandy soils.

Furthermore, it will be appreciated that the surplus material in the connecting corners warrants a better resistance to torsion of the U-shaped sheet piles. It stiffens the webs and the flange, thus reducing the danger of buckling. Moreover, the full plastic moment of the sheet pile and its capacity for rotation in bending mode significantly increase, so that it is possible to mobilise appreciable reserves of plastic deformations before the U-shaped sheet pile reaches its breakdown point.

Cylindrical connecting surfaces, substantially tangential to the faces of the respective flange and web in the said concave corners, seem to give the best results from the point of view of a reduction in the resistance of the sheet pile to pile-driving. This conclusion does not, however, rule out the use of any other types of curved surface, tangential or not to the faces of the respective flange and web, or even polygonal surfaces or a simple plane surface, in order to define the connecting surfaces in the said concave corners, provided of course that the concave corners formed in this way are flat enough to facilitate the flow of soil particles outside the said corners.

Ramming tests carried out in a standardised sand bed have shown that a really significant reduction in the energy of ramming is beginning to be obtained with a cylindrical connecting surface having a radius of 75 mm which is tangential to the faces of the respective flange and web in the concave corners. From this result, it can be deduced generally that to obtain a significant reduction in ramming time, the said extra thickness must be such that the concave corners at the position of the flange/web connections are at least as open as a tangential cylindrical connection of radius 75 mm. In more quantitative terms, it can be said for example that the said local extra thickness must be designed so that a fictitious cylindrical surface which has a radius at least equal to 75 mm and which is tangential to the two planes that would have formed the concave corner connecting the respective flange/web in the absence of the said extra thickness, is located completely inside the said extra thickness between the two tangential generators.

It should be noted that the convex corners at the position of the flange/web connections are preferably only slightly rounded (radius of the rounding $\leqq 25$ mm) so as to confer on the profile as high as possible a moment of inertia by concentrating a maximum amount of material in the outer part of the webs.

It remains to point out that the sheet pile according to the invention is advantageously a steel sheet pile produced by hot rolling.

BRIEF DESCRIPTION OF THE DRAWINGS

A preferred embodiment of a sheet pile according to the invention is described on the basis of the appended drawings, in which.

DETAILED DESCRIPTION OF THE PREFERRED EMBODIMENT OF THE INVENTION

Figure 1:
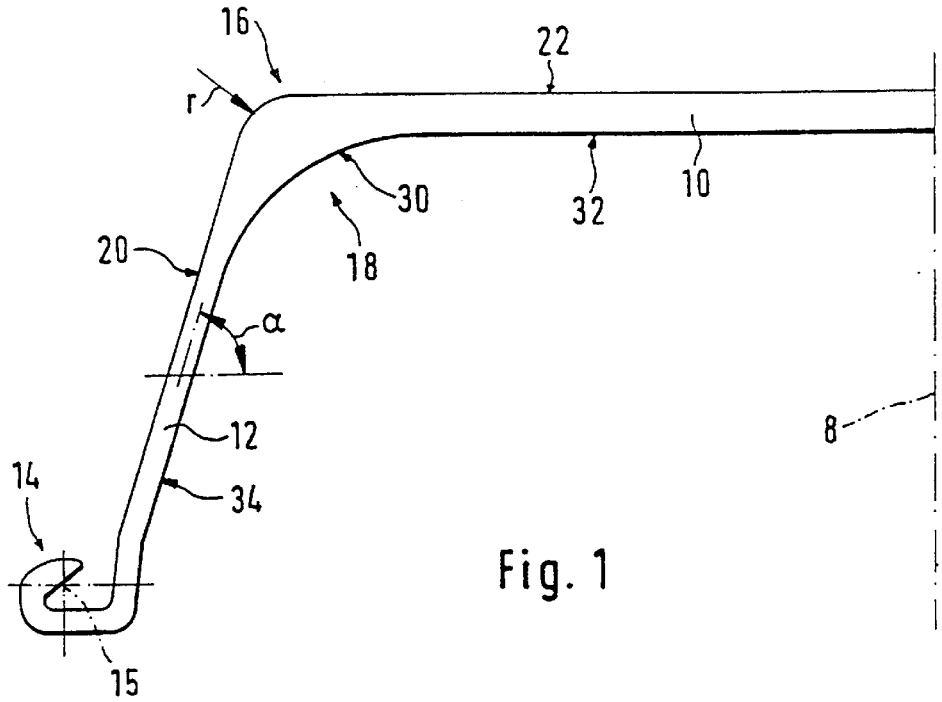
FIG. 1 shows a transverse cross-section of half a sheet pile.

FIG. 1 shows a transverse cross-section of half a U-shaped sheet pile according to the invention. The other half is exactly symmetrical to the half represented with respect to a plane of symmetry denoted by the reference number 8. This sheet pile has a substantially flat flange 10 perpendicular to the plane of symmetry 8 of the cross-section. Two substantially flat webs 12 are connected to this flange 10, only the left-hand web being represented in FIG. 1. Each of these webs 12 carries an interlocking element 14, which makes it possible to form a more or less impervious joint by interlocking with a corresponding interlocking element of another sheet pile. The central axis of the interlocking element 14, which is perpendicular to the plane of the drawing, is denoted by the reference number 15. It should be further noted that the flange 10 is in general substantially thicker than the webs 12.

In the sheet pile represented, the acute angle $_\alpha$ formed between the webs and a plane parallel to the flange is about 74°. It is obvious that this angle may of course be chosen to be smaller or larger. For sheet piles related to the invention, the acute angle $_\alpha$ will normally lie between 40° and 8°.

In what follows, the corner located on the outer side of the sheet pile and denoted in FIG. 1 by the arrow with reference number 16, and the corner symmetrical to it but not represented, will be called the "convex corners defined by the flange/web connections" (or simply "convex corners"); and the corner located on the inner side of the sheet pile and denoted in FIG. 1 by the arrow with reference number 18, and the corner symmetrical to it but not represented, will be called the "concave corners defined by the flange/web connections" (or simply "concave corners").

Figure 2:
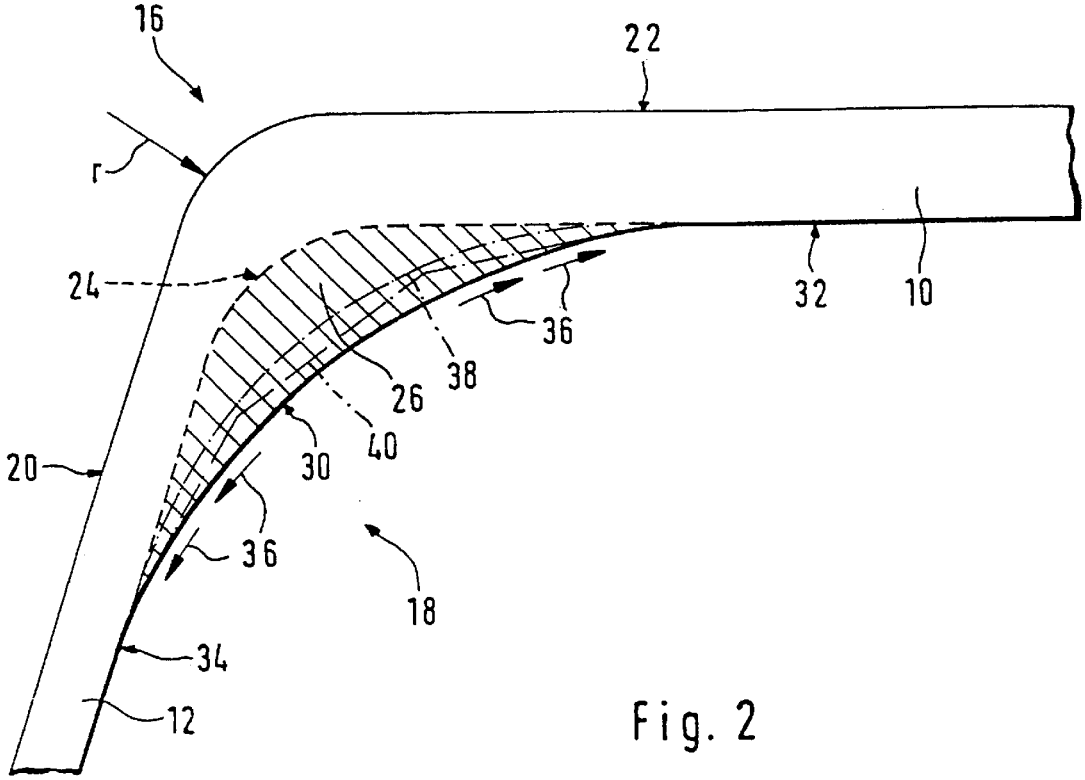
FIG. 2 shows an enlargement of a flange/web connection in the sheet pile of FIG. 1.

The convex corners 16 connect the flat outer faces 20 of the webs 12 to the flat outer surface 22 of the flange 10 (see also FIG. 2). These convex corners 16 are rounded with a radius of curvature "r" determined by the constraints of rolling and/or by safety considerations (avoidance of sharp edges). Normally, "r" will be greater than 10 mm and smaller than 25 mm. The smaller the value of "r", the higher will be the section bending modulus of the profile.

In order to reduce the resistance of the sheet pile to being driven into the ground, the concave corners 18 are, according to the invention, substantially flattened by a local extra thickness of the sheet pile at these places. This modification of the known U-shaped sheet pile will be examined in more detail using FIG. 2. In the later figure, the concave flange/web corner of a standard sheet pile is represented by the broken line (see the lines denoted by the reference number 24 in FIG. 2). It is observed that this concave corner 24 is rounded with a radius of curvature determined by the constraints of rolling and corresponding approximately to the radius "r" of the convex corner 16. The local extra thickness which has made it possible to flatten the standard concave corner 24 and hence to make this corner more open, is represented in the same figure by the cross-hatched area 26. This extra thickness 26 defines a concave connecting surface 30. It remains to point out that the symmetrical concave corner of course has the same appearance.

In the case of the sheet pile represented in FIGS. 1 and 2, the concave connecting surface 30 is a cylindrical connecting surface which is tangential to the flat inner face of the flange 10 and to the flat inner face 34 of the web 12. The arrows 36 in FIG. 2 show how soil particles can flow freely along the cylindrical connecting surface 30, thus avoiding the formation of a highly compacted core of soil in the concave corner 18 which opposes the pile-driving of the U-shaped sheet pile.

Ramming tests carried out in a standardised sand bed have shown that a significant reduction in the energy of ramming is beginning to be obtained with a cylindrical connecting surface having a radius of 75 mm which is tangential to the faces of the respective flange and web in the concave corners at the position of the flange/web connection. In FIG. 2, the path of this "minimum" cylindrical connection is represented by a circular arc drawn as a broken line and denoted by the reference number 38. The circular arc 38, which is tangential to the paths of the two planes 32, 34 that would have formed the concave corner connecting flange and web in the absence of the extra thickness 26, is supposed to determine the minimum extra thickness in the concave corners required to obtain a significant reduction in the ramming energy. It can be seen that the extra thickness of material corresponding to the cylindrical connecting surface 30 is significantly greater, which not only reduces still further the resistance to pile-driving, but also increases the full plastic moment and the capacity of the profile to rotate in bending mode. The reference number 40 denotes the path of a polygonal connecting surface located between the surface 30 and the surface of minimum material 38.

It should be appreciated that the sheet piles described differ from known U-shaped sheet piles, particularly (a) by a lower resistance to pile-driving, which mainly becomes noticeable in sandy soils during an operation using ramming or vibrations;

(b) by a considerable increase in the full plastic moment and the capacity for rotation in bending mode which goes hand in hand with the reduction in resistance to pile-driving, thus permitting a significant increase in efficiency at the site;

(c) by an improvement in the resistance to torsion of the sheet pile;

(d) by a good "elastic section modulus/weight" ratio for a screen formed from such sheet piles because of the possible savings at the level of the thickness of the web and flange outside the flange/web connections;

(e) by a better transmission of forces in the case of supporting screens provided with walings and/or anchor plates.

In conclusion, the present invention has provided a profile for ramming and pile-driving by vibrations which is ideal for use in difficult conditions.

What is claimed is:

1. A U-shaped sheet pile comprising:

a flange having a substantially flat outer face and an opposite, substantially flat inner face;

two webs projecting from said flange on the inner face side, so as to be symmetrical with respect to a plane perpendicular to said inner face, each of said two webs having a substantially flat outer face and an opposite, substantially flat inner face;

a flange/web connection for each of said two webs, each of said flange/web connections defining, on the side where said inner face of the web joins said inner face of the flange, a concave corner that is flattened by an extra thickness of material in said flange/web connection, so as to obtain a reduction in resistance of said sheet pile to pile-driving; and an interlocking element connected to each of said two webs, each of said interlocking elements defining a central axis, wherein said sheet pile has a depth/useful width ratio greater than or equal to 0.18, where the useful width is defined as being a distance between the central axes of said interlocking elements, and the depth is defined as being a distance separating a plane passing through said central axes of said two interlocking elements and said outer face of the flange.

2. The sheet pile according to claim 1, wherein said extra thickness of material in each of said two flange/web connections is designed so that a fictitious cylindrical surface, which has a radius at least equal to 3" and which is tangential to planes extending the inner face of the flange and the inner face of the web in said concave corner, is completely located inside said extra thickness of material between two tangential generators of said fictitious cylindrical surface.

3. The sheet pile according to claim 2, wherein each of said flange/web connections defines, on the side where said outer face of the web joins said outer face of the flange, a convex corner, which is rounded with radius of curvature less than or equal to 1".

4. The sheet pile according to claim 3, wherein said sheet pile is a hot-rolled steel sheet pile.

5. The sheet pile according to claim 2, wherein said concave corner is delimited by curved surfaces.

6. The sheet pile according to claim 5, wherein at least one of the curved surfaces is tangential to the inner flat face of the flange and to the inner flat face of the web.

7. The sheet pile according to claim 2, wherein said concave corner is delimited by polygonal surfaces.

8. The sheet pile according to claim 2, wherein said concave corner is delimited by surfaces comprising at least one flat surface.

9. The sheet pile according to claim 2, wherein said sheet pile is a hot-rolled steel sheet pile.

10. The sheet pile according to claim 2, wherein said sheet pile has a depth/useful width ratio greater than or equal to 0.25.

11. The sheet pile according to claim 1, wherein said concave corner is delimited by curved surfaces.

12. The sheet pile according to claim 11, wherein said curved surfaces include a surface that is tangential to said inner flat faces of the flange and the web.

13. The sheet pile according to claim 12, wherein said sheet pile is a hot-rolled steel sheet pile.

14. The sheet pile according to claim 1, wherein said concave corner is delimited by polygonal surfaces.

15. The sheet pile according to claim 1, wherein said concave corner is delimited by surfaces comprising at least one flat surface.

16. The sheet pile according to claim 15, wherein said sheet pile is a hot-rolled steel sheet pile.

17. The sheet pile according to claim 11, wherein said sheet pile is a hot-rolled steel sheet pile.

18. The sheet pile according to claim 1, wherein said sheet pile has a depth/useful width ratio greater than or equal to 0.25.

19. The sheet pile according to claim 1, wherein each of said flange/web connections defines, on the side where said outer face of the web joins said outer face of the flange, a convex corner which is slightly rounded, the radius of curvature being less than or equal to 1".

* * * * *